United States Patent [19]

Vosatka

[11] 4,062,064

[45] Dec. 13, 1977

[54] EYEGLASS POCKET SHIRT

[76] Inventor: Walter Vosatka, 1047 E. 216 St., c/o Scarbrough, Bronx, N.Y. 10469

[21] Appl. No.: 759,737

[22] Filed: Jan. 17, 1977

[51] Int. Cl.[2] ..... A41D 27/20

[52] U.S. Cl. ..... 2/252

[58] Field of Search ..... 2/252, 253, 250, 247 R

[56] References Cited

U.S. PATENT DOCUMENTS

| | | | |
|---|---|---|---|
| 1,926,866 | 9/1933 | Doniger | 2/253 |
| 2,442,415 | 6/1948 | Kubovcik | 2/252 |
| 2,840,825 | 7/1958 | Garrido | 2/252 |

*Primary Examiner*—Doris L. Troutman

*Attorney, Agent, or Firm*—Richard L. Miller

[57] ABSTRACT

A shirt having a breast pocket that is designed to hold a pair of eyeglasses in a manner so that the eyeglasses cannot fall out accidentally; the pocket depending behind a rear side of the shirt front panel and being closable by a slide fastener.

1 Claim, 5 Drawing Figures

Fig. 1
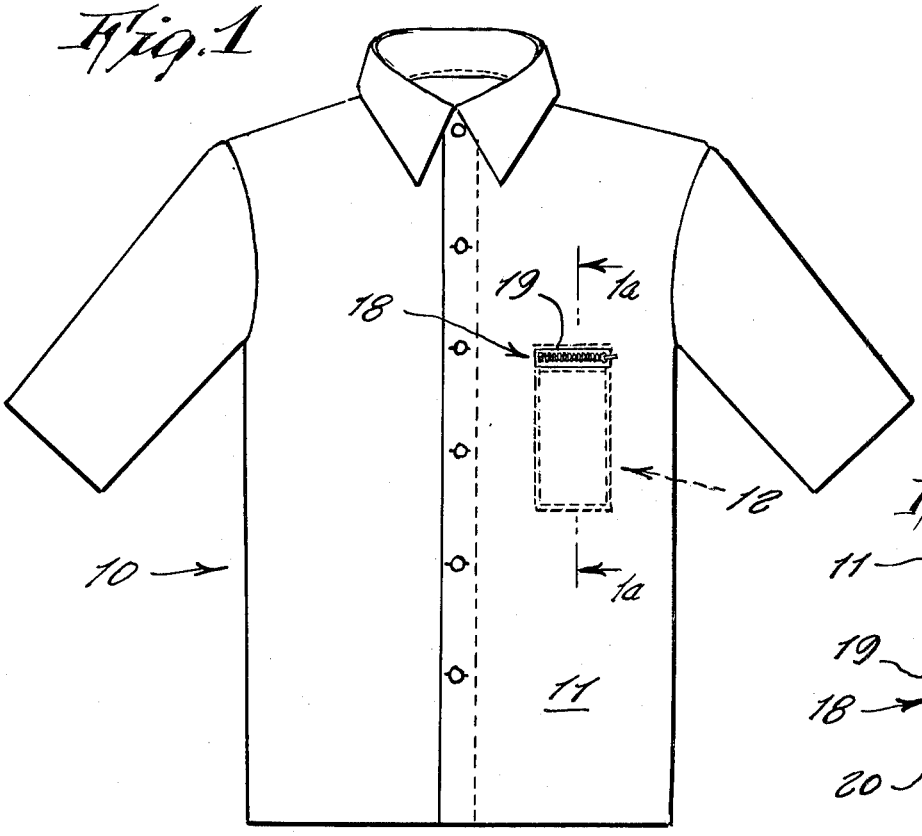
Fig. 1a
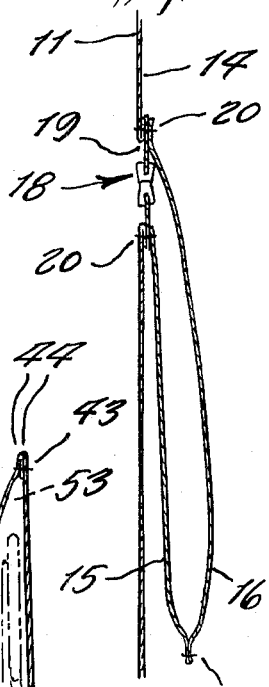
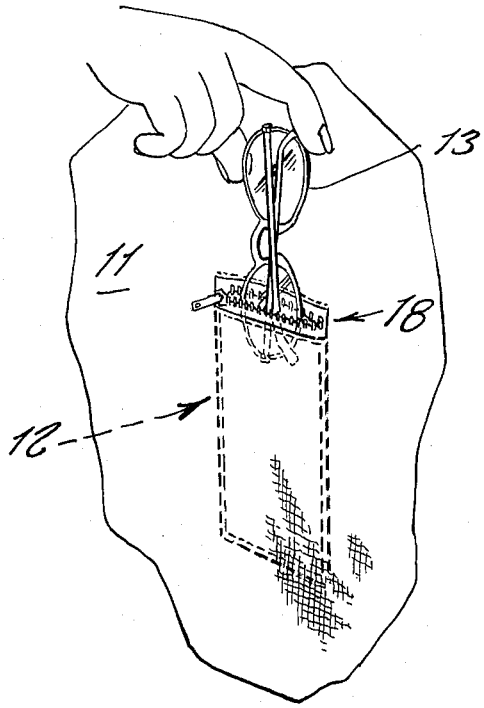
Fig. 2
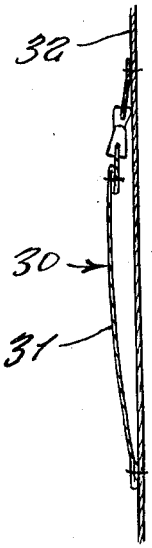
Fig. 3
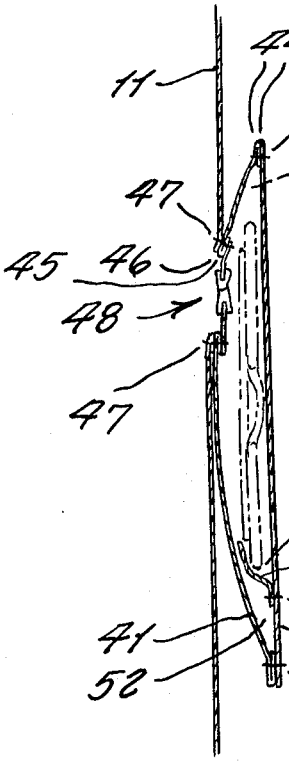
Fig. 4

EYEGLASS POCKET SHIRT

This invention relates generally to shirts and similar types of garments. More specifically, it relates to shirt pockets.

A principal object of the present invention is to provide a shirt having a breast pocket for holding eyeglasses in a manner so that they cannot accidentally fall out.

Another object is to provide an eyeglass pocket shirt which is elongated in shape so that eyeglasses can completely fit inside, and not stick out.

Another object is to provide an eyeglass pocket shirt in which the principles thereof can be incorporated in a jacket or other garment as well.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the apended claims.

FIG. 1 is a front view of a shirt incorporating the pocket invention.

FIG. 1*a* is an enlarged cross sectional view on line 1*a*—1*a* of FIG. 1.

FIG. 2 is a perspective view of the pocket having eyeglasses being placed therewithin.

FIG. 3 is a side cross section of a conventional pocket.

FIG. 4 is a cross section of a modified design of the invention which includes means to prevent eyeglasses accidentally fall out if pocket is left unzipped.

Referring now to the drawing in greater detail, and more particularly to FIGS. 1, 1*a* and 2 thereof at this time, the reference numeral 10 represents an eyeglass pocket shirt according to the present invention, in which a shirt front panel 11 has a breast pocket 12 designed to securely hold a pair of eyeglasses 13. The pocket hangs down hidden behind a rear side 14 of the panel 11 and consists of front and rear walls 15 and 16 peripherally stitched together by thread 17 on all sides except at a top where they are stitched to a slide fastener unit 18 which is the only part that is visible on a front of the shirt. Thus only a narrow horizontal shirt 19 in the panel 11 is provided and the unit 18 is stitched around the periphery of the slit by a thread 20 that also holds the upper edges of pocket walls 15 and 16.

The pocket, being elongated, is deep enough to completely receive the eyeglasses so the pocket can then be zipped closed by the slide fastener of unit 18.

FIG. 2 shows a conventional shirt pocket 30 of a shirt in which a pocket wall 31 is simply stitched all around its periphery on a front side of a shirt panel 32, thus differing from the present invention.

FIG. 4 illustrates a modified design of pocket 40 that includes front and rear walls 41 and 42 peripherally enjoined by thread 43 all around their edges, including top edges 44. A horizontal slit 45 intermediate the upper and lower edges of front wall 41 is aligned with horizontal slit 46 in the shirt front panel. A thread 47 stitched around the edges of the slits 45 and 46 secures the pocket to the panel and also secures a slide fastener unit 48 therebetween so to selectively close the pocket entrance. A horizontal tape 49 stitched by thread 50 to a lower portion of rear wall 42 forms a shallow inner pocket 51.

In use, eyeglasses 13 are inserted through the pocket entrance downwardly into pocket lower end 52 after which the upper end of the eyeglasses are then pushed upwardly into pocket upper end 53 so to permit the eyeglasses lower end to drop into the inner pocket 51. In this position the eyeglasses cannot fall out even if the pocket is left unzipped.

Also, in this position, papers and other objects can be supported at their lower ends in the pocket lower end 52 and without accidentally also pulling out the eyeglasses at the same time, and possibly dropping them, as often occurs with conventional pockets.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. An eyeglass pocket shirt, comprising in combination, a shirt garment having a front panel with a horizontal slit, a slide fastener unit stitched to opposite side edges of said slit selectively closing said slit, and a depending pocket attached to a rear side of said panel communicating with said slit, said pocket being elongated in shape to completely receive a pair of eyeglasses; said pocket comprising front and rear walls peripherally stitched together all around, a horizontal slit on said front wall being aligned with said shirt front panel slit, upper edges of both said slits being stitched together and lower edges of both said slits being stitched together, an upper end of said pocket extending higher than said slits, and means to retain said eyeglasses in said upper end comprising a horizontal tape stitched along its lower edge to a vertically intermediate portion of said rear wall, said tape forming a shallow inner pocket within an interior of said pocket and which is positioned at a higher elevation than a lower end of said pocket.

* * * * *